US005323210A

United States Patent [19]

Inomata

[11] Patent Number: 5,323,210

[45] Date of Patent: Jun. 21, 1994

[54] IMAGE FORMING APPARATUS FEATURING A MULTIPLE MODE SERVICE ACCESS MAIN ASSEMBLY

[75] Inventor: Mitsugu Inomata, Kawasaki, Japan

[73] Assignee: Canon Kabushiki Kaisha, Tokyo, Japan

[21] Appl. No.: 946,569

[22] Filed: Sep. 18, 1992

[30] Foreign Application Priority Data

Sep. 20, 1991 [JP] Japan ..... 3-268628

[51] Int. Cl.[5] ..... G03G 15/00

[52] U.S. Cl. ..... 355/200; 355/210

[58] Field of Search ..... 355/200, 210, 211, 245, 355/260, 326, 327

[56] References Cited

U.S. PATENT DOCUMENTS

| | | | |
|---|---|---|---|
| 4,583,844 | 4/1986 | Honda | 355/309 |
| 4,760,424 | 7/1988 | Ohba et al. | 355/245 |
| 4,873,548 | 10/1989 | Kobayashi et al. | 355/200 |
| 4,924,267 | 5/1990 | Yoshikawa et al. | 355/210 |
| 4,928,144 | 5/1990 | Kasahara et al. | 355/245 |
| 5,005,053 | 4/1991 | Kozuka | 355/245 |
| 5,036,367 | 7/1991 | Haneda et al. | 355/260 |
| 5,041,872 | 8/1991 | Nukaya et al. | 355/200 |
| 5,065,195 | 11/1991 | Haneda et al. | 355/210 X |

FOREIGN PATENT DOCUMENTS

| | | | |
|---|---|---|---|
| 0370455 | 5/1990 | European Pat. Off. . | |
| 0473182 | 3/1992 | European Pat. Off. . | |
| 2-153369 | 6/1990 | Japan . | |
| 2-157870 | 6/1990 | Japan . | |
| 0214172 | 9/1991 | Japan | 355/327 |

OTHER PUBLICATIONS

European Search Report.

*Primary Examiner*—A. T. Grimley
*Assistant Examiner*—William J. Royer
*Attorney, Agent, or Firm*—Fitzpatrick, Cella, Harper & Scinto

[57] ABSTRACT

An image forming apparatus includes first and second frames separable from each other, wherein the first and second frames constitutes a main assembly of the image forming apparatus; a process cartridge detachably mountable to the main assembly, wherein the process cartridge contains an image bearing member and at least one image forming device actable on the image bearing member; a developing unit detachably mountable to the main assembly separately from the cartridge, the developing unit forming a developed image on the image bearing member; wherein the main assembly is separable in a first mode in which the cartridge and the developing unit are in either of the first frame or the second frame and in a second mode in which the cartridge and the developing unit are in different ones of the first and second frames.

19 Claims, 11 Drawing Sheets

IMAGE FORMING APPARATUS FEATURING A MULTIPLE MODE SERVICE ACCESS MAIN ASSEMBLY

FIELD OF THE INVENTION AND RELATED ART

The present invention relates to an image forming apparatus such as a copying machine or printer, more particularly to an image forming apparatus usable with a process cartridge detachably mountable thereto and a developing unit which is separate from the process cartridge and which is detachably mountable thereto.

In order to make maintenance operations easier, an image forming apparatus has been put into practice in which an image bearing member and at least one of an image forming means actable thereon is unified in the form of a cartridge, which is detachably mountable to a main assembly of the image forming apparatus. In addition, an image forming apparatus has been proposed in which the process cartridge and a developing unit are separately, detachably mountable to the main assembly of the image forming apparatus. With this structure, when the service life of the image bearing member or another image forming means in the process cartridge is different from the consumption of the developer in the developing unit are different, the structure is economical since only one of the process cartridge or the developing unit that requires exchange, can be changed. Particularly in the case of a color image forming apparatus using plural color developers, the consumption speed of the different color developers, are not necessarily the same. In this case, the developer, which is quickly consumed, is accommodated in a developing unit which is separate from the process cartridge, and the other developer or developers are accommodated in the process cartridge. Then, only the developer, which is quickly consumed, can be replenished without exchanging the other part, and therefore, it is economical.

However, the number of parts detachably mountable to the main assembly increases, so that the operativity is worsened. For example, even when only the developing unit is to be exchanged, the developing unit can not be taken out without taking out the cartridge. In another example, when the jammed sheet is to be cleared, the developing unit as well as the cartridge, has to be taken out.

SUMMARY OF THE INVENTION

Accordingly, it is a principal object of the present invention to provide an image forming apparatus in which the operativity of the process cartridge and the developing unit is improved.

It is another object of the present invention to provide an image forming apparatus which is openable in a first mode in which a cartridge and a developing unit are both in the same frame, and in a second mode in which the cartridge and the developing unit are in different frames.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
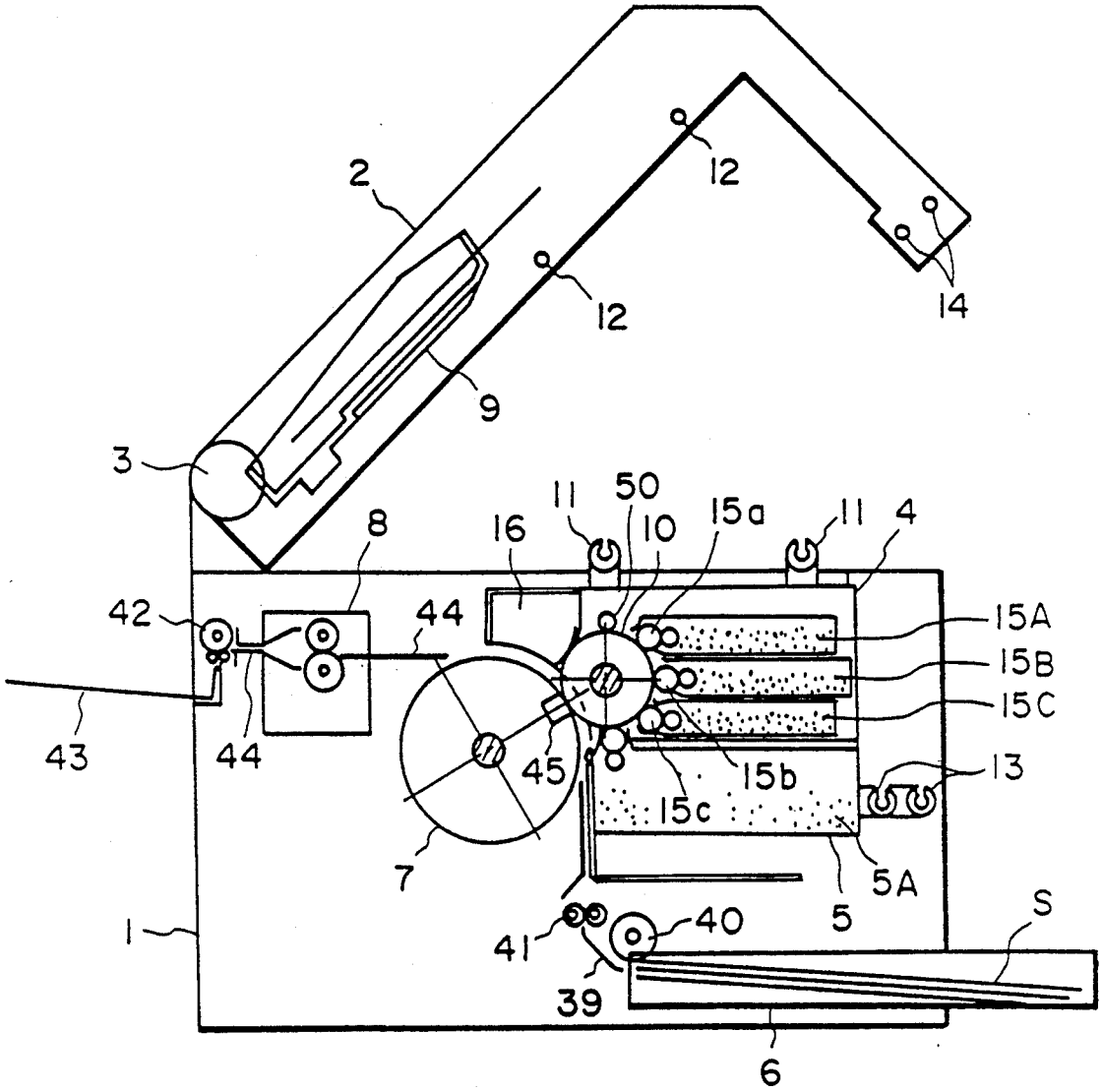
FIG. 1 is a sectional view of an image forming apparatus according to a first embodiment of the present invention, where it is opened in a first mode.

Referring to the accompanying drawings the perferred embodiments of the present invention will be described in detail. In these examples, the image forming apparatus comprises a detachably mountable process cartridge having a plurality of developing means and a detachably mountable developing unit. However, the process cartridge may be different provided it contains an image bearing member and at least one image forming means actable on the image bearing member.

Referring to FIGS. 1, 2, 3, 4 and 5, an image forming apparatus according to a first embodiment of the present invention will be described. A main assembly of a multi-color image forming apparatus according to this embodiment of the present invention, comprises a lower frame (first casing) 1 and an upper frame (second casing) 2, which is rotatable relative to the lower frame, about a shaft 3. The main assembly accommodates a process cartridge 4 and a sub-cartridge (developing unit) 5, which are separately detachably mountable thereto. The sub-cartridge 5 is positioned relative to an image bearing member 10 in the main cartridge 4. The main cartridge 4 contains an image bearing member 10, three color developing devices 15A, 15B, and 15C (image forming means) positioned relative to the image bearing member 10, a cleaner 16 (image forming means), a charger 50 (image forming means), or the like. The sub-cartridge 5 contains one color developing device 5A positioned relative to the image bearing member 10 of the main cartridge 4.

In addition, the main assembly 1 contains a sheet feeding unit 6, an image transfer drum 7, an image fixing unit 8, and the like. The upper frame 2 is provided with a scanner unit 9.

The following description will be made with respect to an image forming process. The image bearing member in the form of a photosensitive drum 10 is uniformly charged by the charger 50. Then, light is projected from a scanner unit 9 onto the photosensitive member 10 in the main cartridge 4 in accordance with the color of the developer of the developing device 15A, so that an electrostatic latent image for the color is formed. The latent image on the photosensitive member is passed through a position where a developer carrying member (developing sleeve) **15*a* of the developing device 15A is opposed to the image bearing member. (Developer carrying members 15*b* and 15*c*, are provided in developing devices 15B and 15C, respectively.) At this time, the developer (toner) carried on an outer periphery of the sleeve 15*a* is transferred onto the image bearing member 10 to develop the latent image into a visualized image. In the case of an overlaid development and simultaneous transfer system, the latent image formation and the image development are repeated on the image bearing member in accordance with the selected developing device 15B, 15C, and 5A. In this manner, plural developed images are formed on the image bearing member 10** and they are simultaneously transferred onto a transfer material. The transfer material is subjected to an image fixing operation, and is discharged. In the case of overlaid transfer system, the first color developed image is transferred onto a transfer material or an intermediate transfer member, and the latent image formation, development and transfer operation is repeated for the required colors. The transfer material is then subjected to an image fixing operation, and is discharged. When the images are transferred onto an intermediate transfer member, the images are sequentially transferred from the intermediate transfer member onto the transfer material. Then, the transfer material is subjected to an image fixing operation and is discharged. At the time of the development for each color, a developing bias is applied between the developer carrying member of the developing device and the image bearing member, the developer carrying member is rotated, and/or the distance between the developer carrying member and the image bearing member is reduced to a developable gap therebetween. By doing so, the developing action occurs. The image transfer of the developed image from the image bearing member onto the transfer material or onto the image transfer member, is effected by an electric force provided by the various voltage for moving the developer (developed image) of the image bearing member onto the transfer material and physical force due to the contact of the transfer member and the developer.

In this embodiment, an overlaid transfer system is used. The transfer sheet supplied from the sheet feeding unit 6 is retained on an outer periphery of the transfer drum 7, and the developed images of the colors are sequentially transferred from the image bearing member 10 onto the sheet. The sheet having received the transfer of the developed image is fed to an image fixing unit 8 after being separated from the transfer drum 7. Then, it is subjected to the image fixing operation and is discharged to the outside of the main assembly.

In FIG. 1, a reference numeral 6 designates a sheet feeding unit for accommodating a transfer material or recording sheet S; 39, a guide, 40, a pick-up roller for singling out the recording sheet S from the sheet feeding unit; 41, a registration roller; 42, a discharging roller; 43, a sheet discharging tray; 44, a guide; and 45, a transfer discharger .

In this embodiment, the main cartridge 4 is provided with two engaging members 11, and the sub-cartridge 5 is similarly provided with two engaging members 13.

Figure 4:
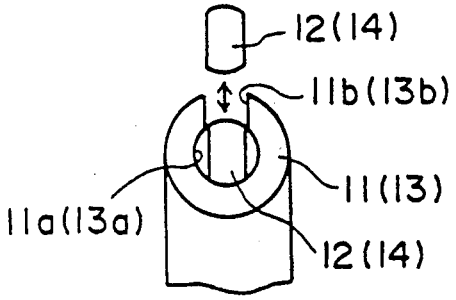
FIG. 4 is a front view illustrating engagement between a shaft and an engaging member in a holding mechanism.
Figure 5:
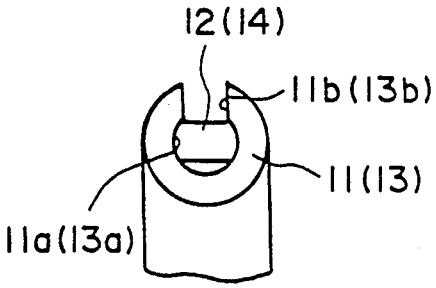
FIG. 5 is a front view illustrating engagement between a shaft and an engaging member in a holding mechanism.

The upper frame 2 is provided with two rotatable shafts 12 and 14 extending in a direction perpendicular to the sheet of the drawing. The shafts 12 and 14 are adapted to be engaged with the engaging members 11 and 13, respectively of the main cartridge 4 and the sub-cartridge 5. The engaging member 11 (13), as shown in detail in FIGS. 4 and 5, is provided with an engaging hole **11*a* (13*a*) and a groove 11*b* (13*b*) cutaway portion in the engaging hole 11*a* (13*a*). When the shaft 12 (14) engageable with the engaging hole 11*a* (13*a*) is in the phase shown in FIG. 4, the shaft 12 (14) penetrates through the groove 11*b* (13*b*) of the engaging member 11 (13) and is released from the engaging member 11 (13). When the shaft 12 (14) is in the phase shown in FIG. 5 by 90 degrees rotation from the state shown in FIG. 4, the shaft 12 (14) is unable to penetrate through the groove 11*b* (13*b*) of the engaging member 11, and therefore, the shaft 12 (14) and the engaging member 11 (13**), are in engagement.

When the apparatus is opened by opening the upper frame 2 with the shafts 12 and 14 are in the phase shown in FIG. 4, the shafts 12 and 14 are allowed to be released from the engaging members 11 and 13, respectively. Therefore, as shown in FIG. 1, the main cartridge 4 and the sub-cartridge 5 both remain in the main assembly 1 (first mode). Then, the main cartridge 4 can be taken out of the main assembly 1 and may be exchanged with a fresh one.

Figure 2:
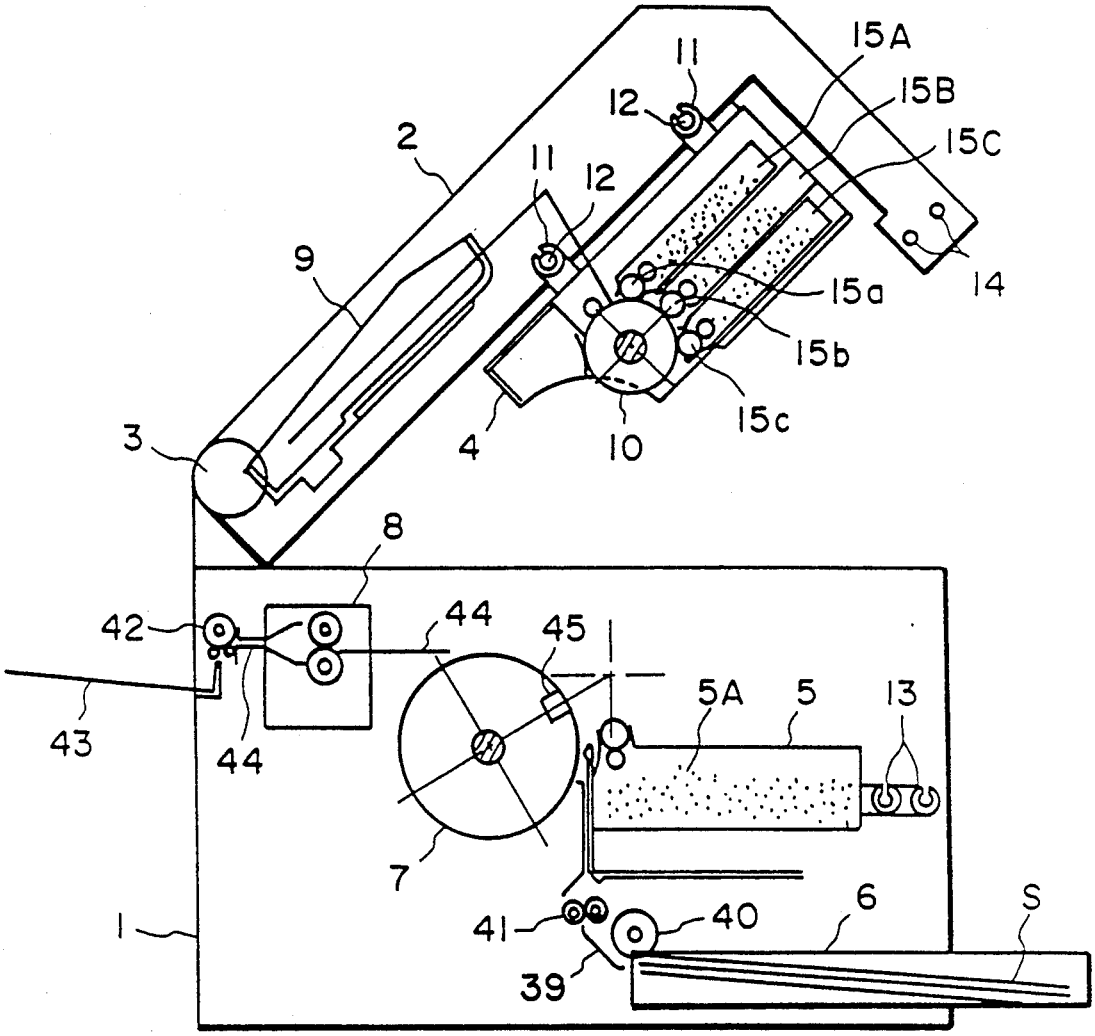
FIG. 2 is a sectional view of the image forming apparatus which is opened in a second mode.

When the upper frame 2 is opened, shaft 12 is in the phase shown in FIG. 5, and the other shaft 14 is in the phase of FIG. 4, then the shaft 12 is engaged with the engaging member 11, and therefore, the shaft 14 is released from the engaging member 13. Therefore, as shown in FIG. 2, the main cartridge 4 is raised together with the upper frame 2, and only the sub-cartridge 5 remains in the main assembly 1 (second mode). Accordingly, with this mode, only the sub-cartridge 5 can be taken out of the main assembly 1 and can be exchanged with a fresh one. It should be noted that there is no need of taking the main cartridge 4 out of the main assembly 1. This improves the operativity.

Figure 3:
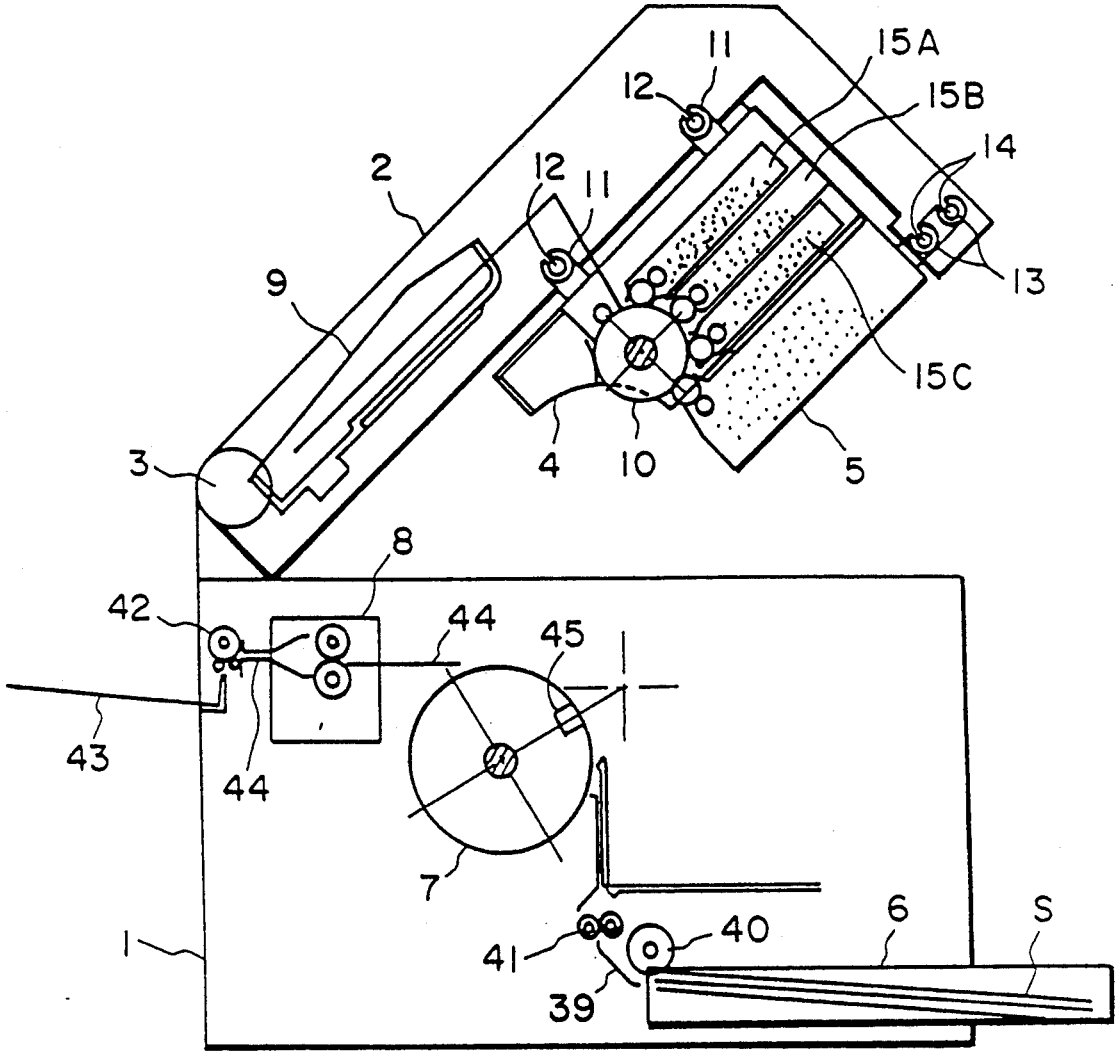
FIG. 3 is a sectional view of the image forming apparatus which is opened in a third mode.
Figure 13:
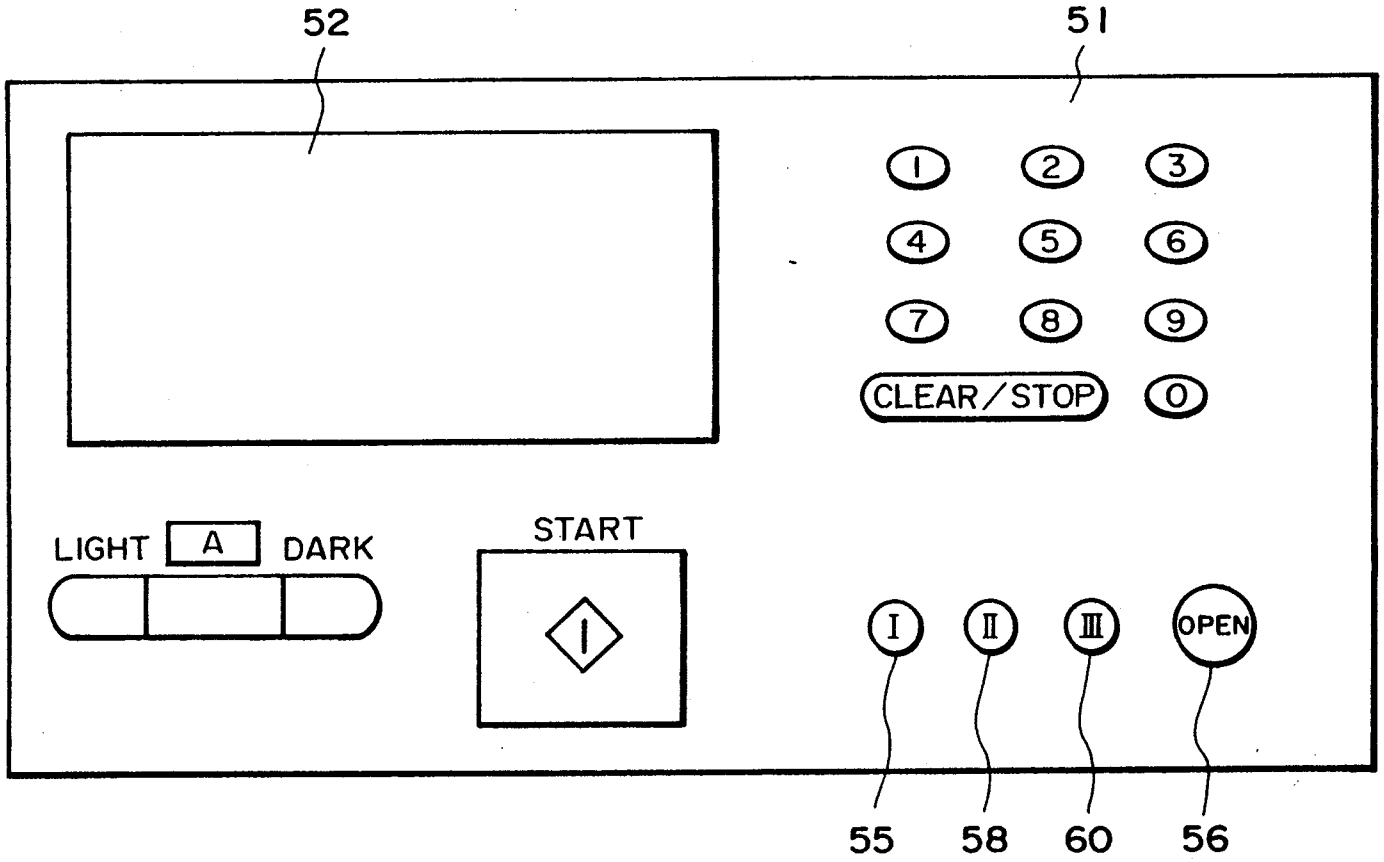
FIG. 13 shows an operation panel of an image forming apparatus according to an embodiment of the present invention.

Furthermore, when the upper frame 2 is opened with the shafts 12 and 14 being in the phases shown in FIG. 5, the shafts 12 and 14 are engaged with the engaging members 11 and 13. Therefore, both of the main cartridge 4 and the sub-cartridge 5 are raised together with the upper frame 2, as shown in FIG. 3. In other words, the apparatus can be opened with the cartridge 4 and the developing unit 5 placed in the frame which is different from the frame in the first mode (third mode). In this mode, a jammed sheet in the sheet feeding unit 6 or the transfer drum 7 can be easily removed, and the transfer drum 7 can be easily cleaned or serviced with good operativity. The first, second and third modes, may be selected by a selector 55 shown in FIG. 13. As will be understood from the foregoing, the apparatus of this invention is openable in a first mode in which the process cartridge and the developing unit are both in one of the first and second frames, and in a second mode in which the process cartridge and the developing unit are in the different frames. By doing so, the maintenance operation, such as jam clearance, or cartridge or developing unit exchange, can be carried out without difficulty, despite the fact that plural elements are detachably mountable to the main assembly. It is further preferable that a display means is provided to notify the operator of which mode is to be selected. As for such display means, a display 52 may be provided on the operation panel 51, as shown in FIG. 13. The display sequence will be described in conjunction with a block diagram of FIG. 14 and a flowchart of FIG. 15.

When a sensor (first detecting mean 53) for detecting a remaining amount of the toner in the process cartridge detects a toner empty condition (step 2), or when a residual toner sensor detects a full residual toner condition (third detecting means 54), detects a full cleaner (step 1), a display promoting the operator to exchange the cartridge 4 is displayed on the display 52 (step 5). Also displayed on the display 52 is the mode which the operator should select. Then, the operator depresses the switches 55 and 56 on the operation panel 51 to open the apparatus in the first mode, by which the second frame 2 is opened.

When a sensor for detecting the remaining amount of the toner in the developing unit 5 (second detecting means 57) detects toner empty (step 3), the display 52 promotes exchange of the developing unit 5 (step 6). Furthermore, the display 52 also displays that the second mode is to be selected by the operator. Then, the operator depresses the switches 58 and 56 to select the second mode on the operation panel 51, by which the second frame 2 is opened.

When a jammed sheet is detected by a jam sensor 59 disposed along a sheet passage (step 4), the display 52 promotes the operator to open the apparatus in the third mode (step 7). Then, the operator depresses the switches 60 and 56 on the operation panel 51 to open the apparatus in the third mode, so that the second frame is opened in the third mode.

In the foregoing example, the first, second, and third modes are selected by selector switches 55, 58, and 60. It is further preferable that the first, second, and third modes are automatically selected by a controller 61 in accordance with detection signals from the sensors 53, 54, 57, and 59.

If a plurality of developing units are used, the opening modes are changed, accordingly.

Figure 14:
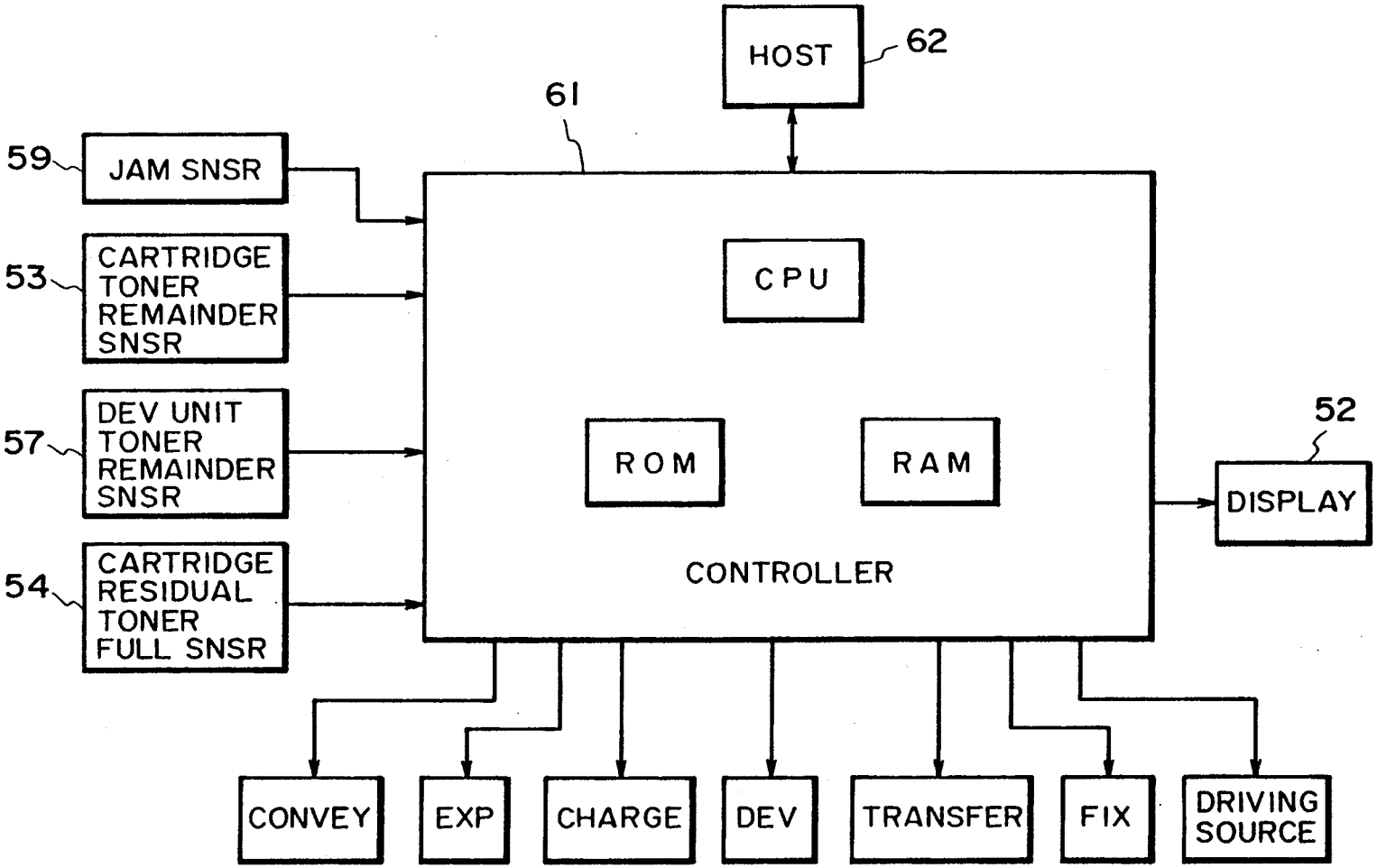
FIG. 14 is a block diagram of a control system of an image forming apparatus according to an embodiment of the present.
Figure 15:
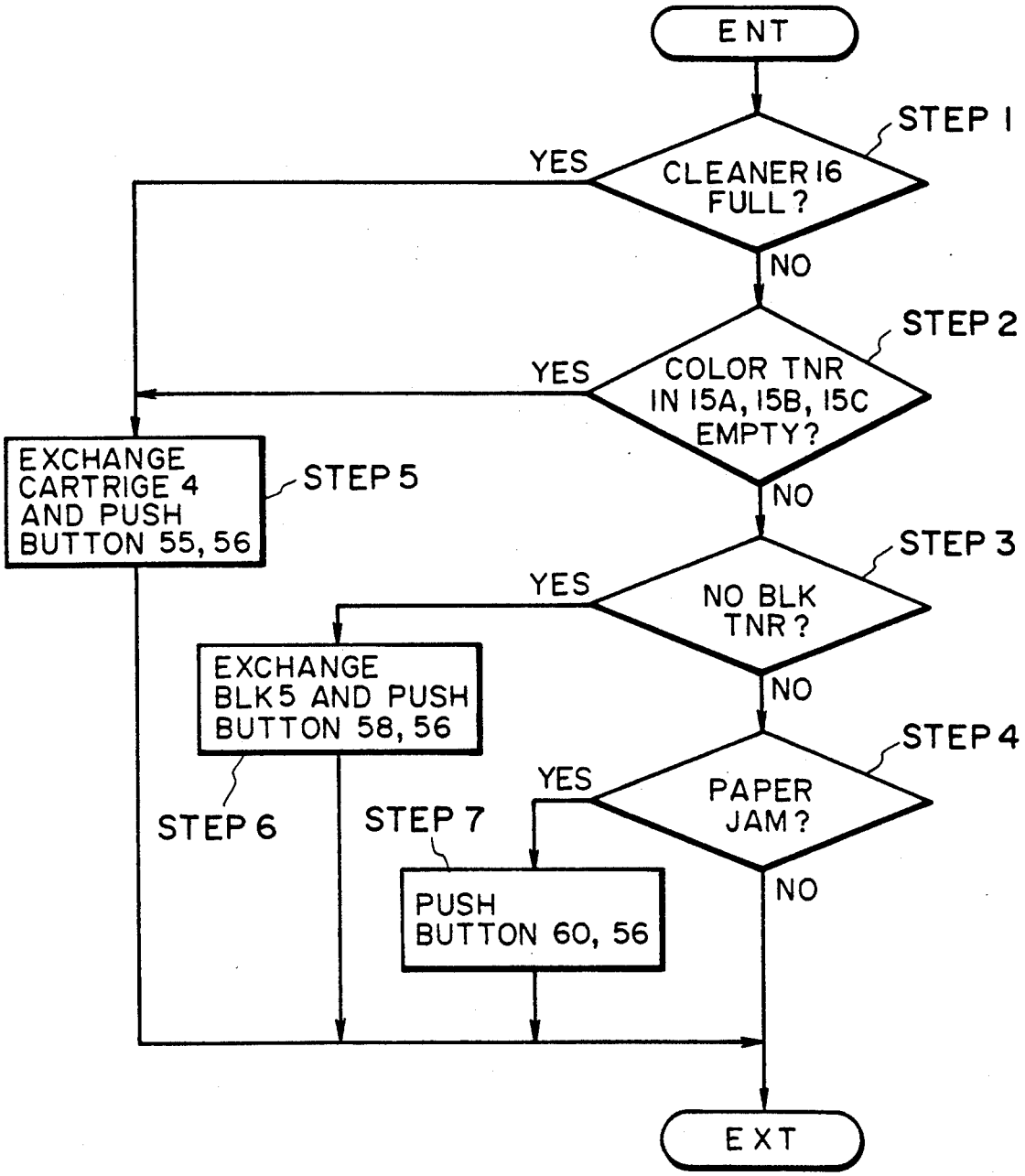
FIG. 15 is a flowchart showing a relation between a sensor and a display of an image forming apparatus according to an embodiment of the present invention.

The block diagram of FIG. 14 will be described in detail. A controller 61 for controlling the entirety of the image forming apparatus comprises a CPU in the form of a microprocessor or the like, a ROM for storing control program or various data, and a RAM which is used as a work area of the CPU and which temporarily stores various data.

The controller 61 receives signals from a sheet jam sensor 59 and a remaining toner detecting mechanism 53 for detecting the remaining amount of the toner in the process cartridge. The detecting mechanism 53 may include an antenna line to detect the change of the electrostatic capacity between itself and the developing sleeve. Furthermore, it receives image signals from a host device 62 in the form of a computer or a word processor or the like.

In response to such signals, the controller 61 controls, the image exposure operation, charging operation, developing operation, image transfer operation, image fixing operation (process operations), conveyance of the recording material (registration roller, discharging roller or the like), and a driving source.

Figure 6:
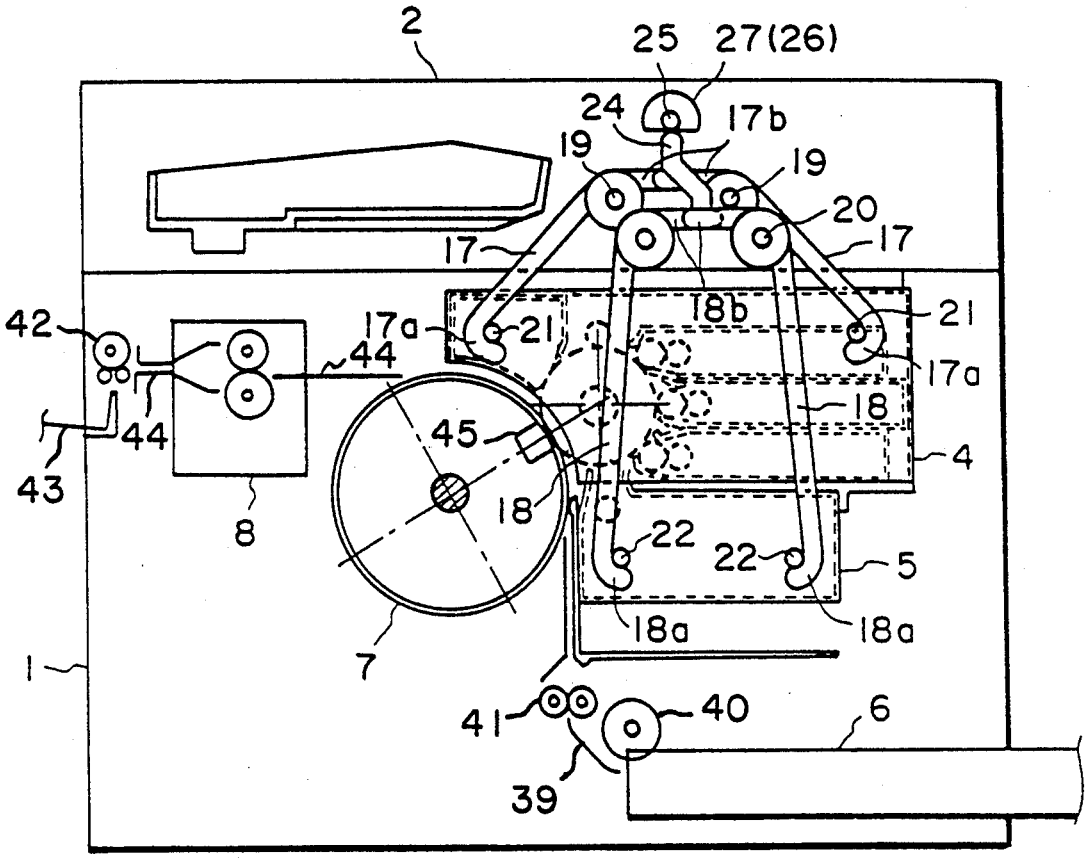
FIG. 6 is a sectional view of an image forming apparatus according to a second embodiment of the present invention.
Figure 7:
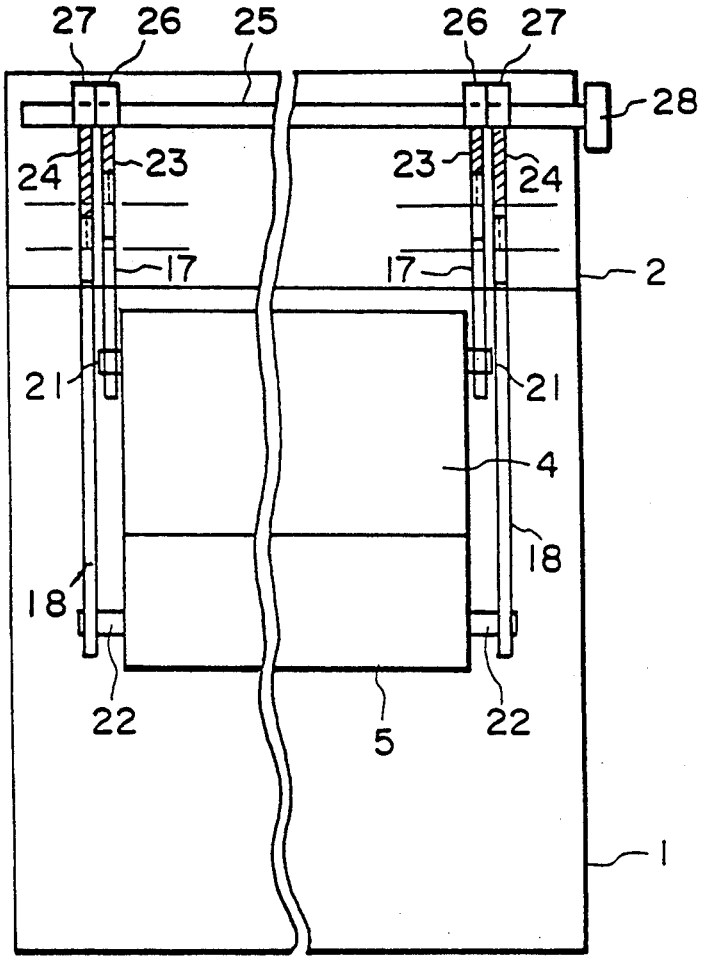
FIG. 7 is a front sectional view of an image forming apparatus according to the second embodiment of the present invention.

Referring to FIGS. 6 and 7, a second embodiment of the present invention will be described. FIG. 6 is a side sectional view of a multi-color image forming apparatus according to this embodiment. FIG. 7 is a front sectional view of the same. The same reference numerals as in FIGS. 1-3, are assigned to the elements having the corresponding functions, and the detailed description thereof are omitted for simplicity.

In this embodiment, the main cartridge 4 and the sub-cartridge 5 are provided with two projections 21 and 22, respectively. The upper frame 2 is provided with hooks 17 and 18 rotatable about respective shafts 19 and 20. End portions **17*a* and 18*a* of the hooks 17 and 18 are selectively engageable with the projections 21 and 22. They are provided with arms 17*b* and 18*b* which are crossed at the center of the shafts 19 and 20. To the crossing portions of the arms 17*b* and 18*b*, two members 23 and 24** guided in perpendicular directions, are contacted.

The upper frame 2 is provided with a rotatable shaft 25 extending in a direction of the sheet of the drawing of FIG. 6 (horizontal direction in FIG. 7). In the middle portion of the length of the shaft 25, two cams 26 and 27 are fixed, and the two cams are contactable to the members 23 and 24. A knob 28 is fixedly mounted to an end of the shaft 25. Each of the cams 26 and 27 has a large radius portion and a small radius portion. The cams 26 and 27 are rotatable by the knob 28. When the large radius portions of the cams 26 and 27 are contacted to the members 23 and 24, the members 23 and 24 are lowered Go lower the crossing portions of the arms **17*b* and 18*b* of the hooks 17 and 18, so that the hook members 17 and 18 are opened to release the engagement between end portions 17*a* and 18*a* of the hooks 17 and 18 with the projections 21 and 22**.

When small radius portions of the cams 26 and 27 are contacted to the members 23 and 24, the hooks 17 and 18 are closed, and the end portions **17*a* and 18*a* of the hooks 17 and 18 are engaged with the projections 21 and 22. The selection of the large or small radius portions of the cams 26 and 27 are determined by the position of the knob 28. When the upper frame 2 is opened with the large radius portions of the cams 26 and 27 contacted to the members 23 and 24, the engagements between the hooks 17 and 18 and the projections 21 and 22, are released, by which both of the main cartridge 4 and the sub-cartridge 5 remain in the main assembly 1. In this state, the main cartridge 4 is taken out of the main assembly 1** and can be exchanged with a fresh one.

When a small radius portion of cam 26 cams is contacted to the member 23 by rotating the knob 28, and a large radius portion of the other cam 27 is contacted to the member 24, one of the hooks 17 is engaged with the projection 21, and the other hook 18 is released from the engagement with the projection 22. When the upper frame 2 is opened in this state, the main cartridge 4 is raised with the upper frame 2, while the sub-cartridge 5 remains in the main assembly 1. The sub-cartridge 5 may be taken out of the main assembly 1, and may be exchanged with a fresh one.

When the small radius portions of the cams 26 and 27 are contacted to the members 23 and 24 by rotation of the knob 28, the hooks 17 and 18 are engaged with the projections 21 and 22. When the upper frame 2 is opened, the main cartridge 4 and the sub-cartridge 5 are both raised together with the upper frame 2. Therefore, the jammed sheet in the sheet feeding unit 6 or the transfer drum 7, may be removed, or the transfer drum may be cleaned or serviced, with high operativity.

Figure 8:
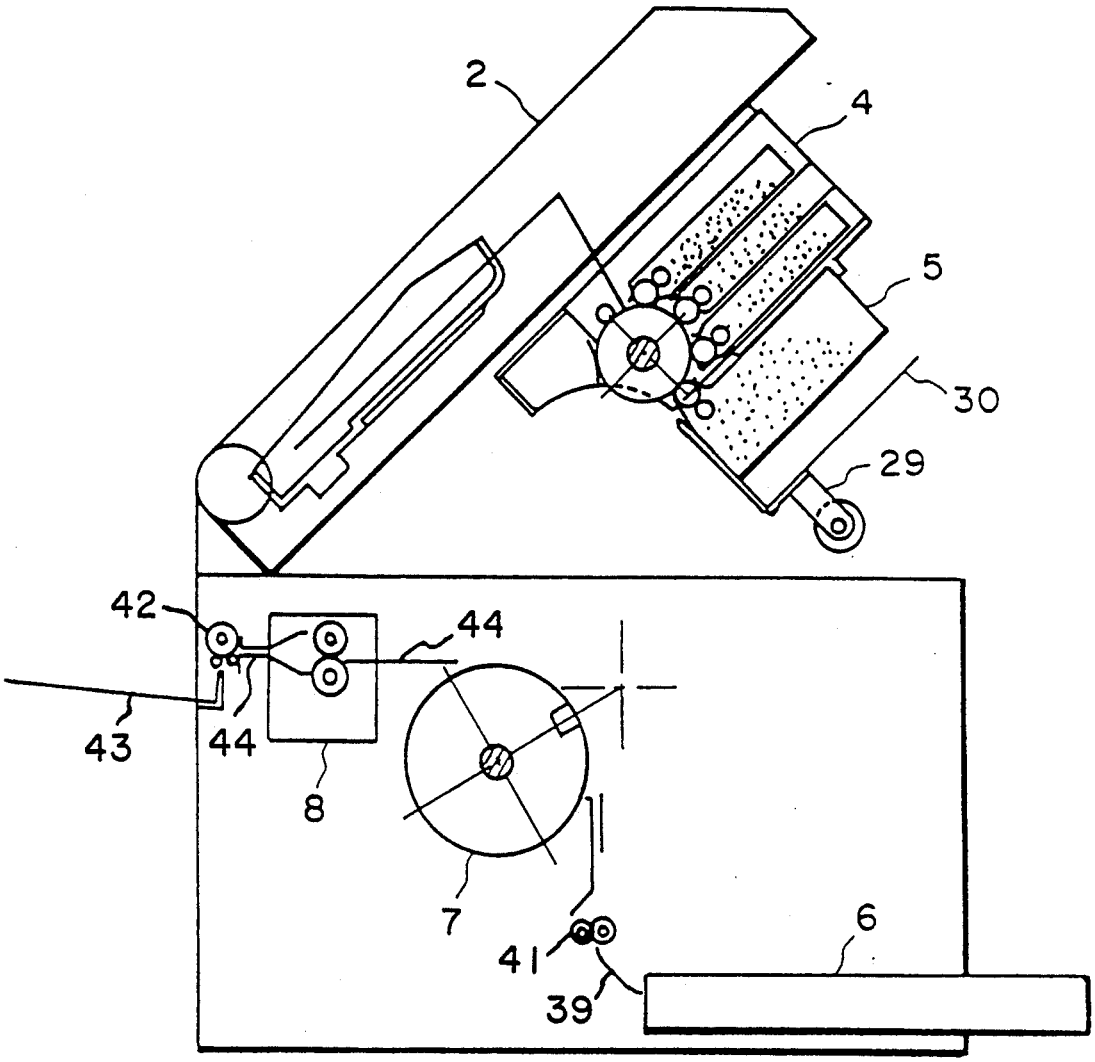
FIG. 8 is a sectional view of an image forming apparatus according to a third embodiment of the present invention.
Figure 9:
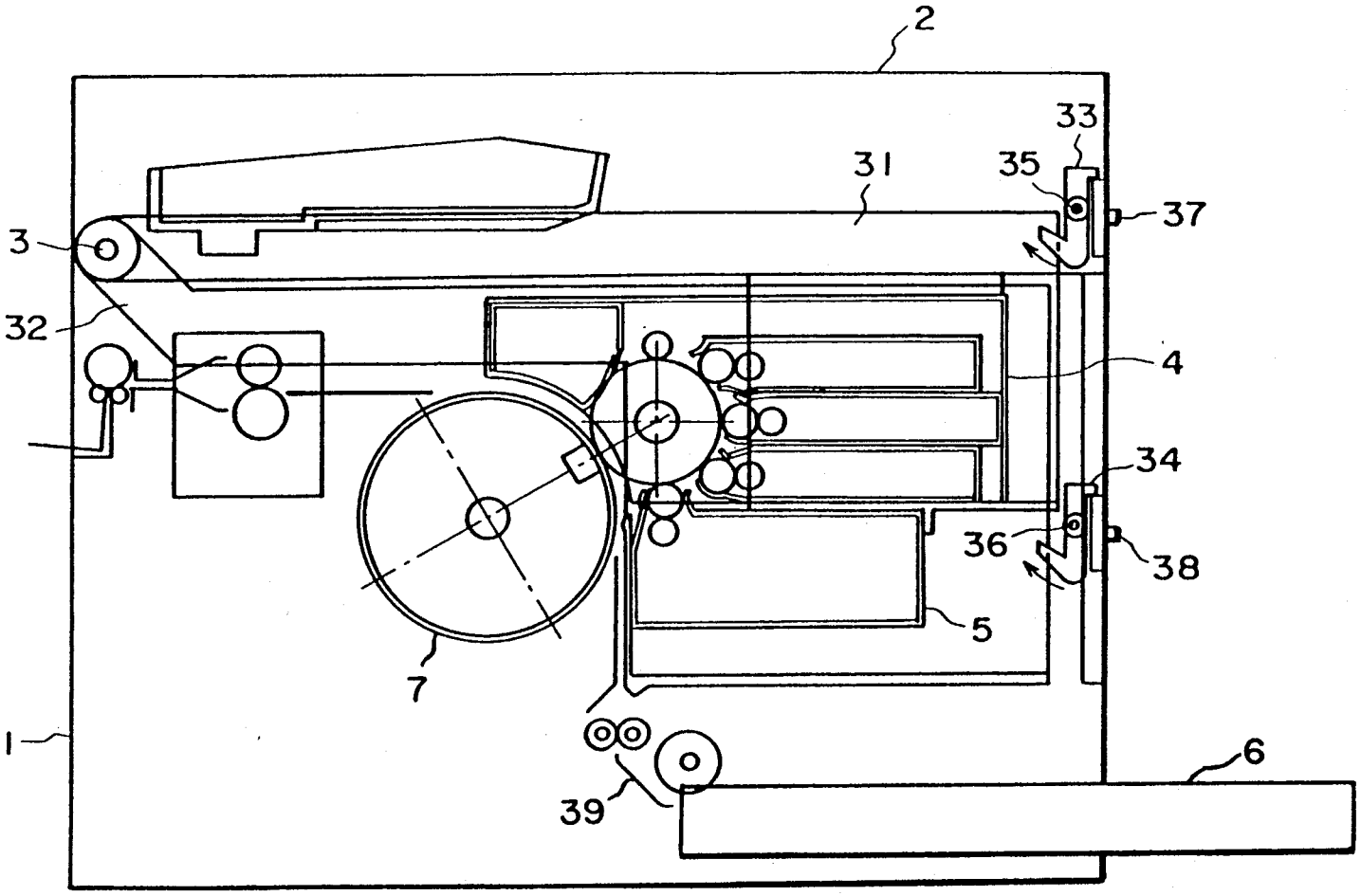
FIG. 9 is a sectional view of an image forming apparatus according to a fourth embodiment of the present invention.

Referring to FIG. 8, a third embodiment of the present invention will be described. FIG. 8 is a sectional view of a multi-color image forming apparatus according to this embodiment.

In this embodiment, too, similarly to the first and second embodiments, the main cartridge 4 and/or the sub-cartridge 5, is raised together with the upper frame 2 by a selection and holding mechanism. In this embodiment, when the main cartridge 4 and the sub-cartridge 5 are raised together with the upper frame 2 as shown in the FIG. for the purpose of jam clearance, a part 29 of the sheet feeding mechanism is raised together. At this time, the sub-cartridge 5 is fixed on a member 30 supporting the part 29 of the sheet feeding mechanism, so that it is raised by the upper frame 2 together with the member 30.

In the first and second embodiments, the engaging member 13 (FIG. 1) and the projection 22 (FIG. 6) are provided in the sub-cartridge 5 itself, but it is provided on the member 30 in this embodiment.

Since the part 29 of the sheet feeding mechanism is raised together with the sub-cartridge 5 by .the upper frame 2 in this embodiment, the jam clearance operation is made even easier.

Figure 10:
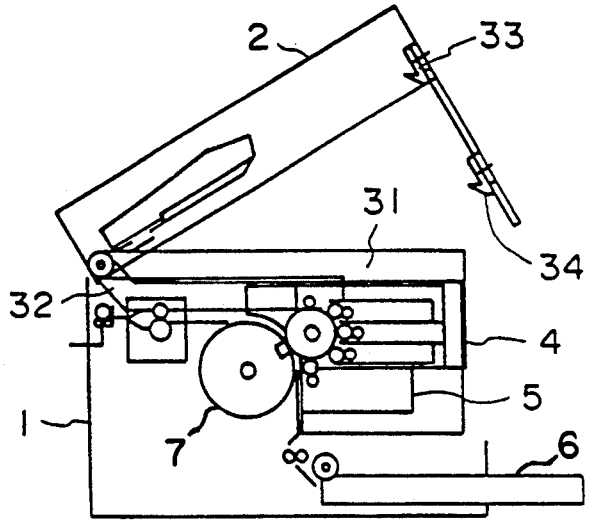
FIG. 10 is a sectional view of an image forming apparatus according to the fourth embodiment of the present invention, which is opened in a first mode.
Figure 11:
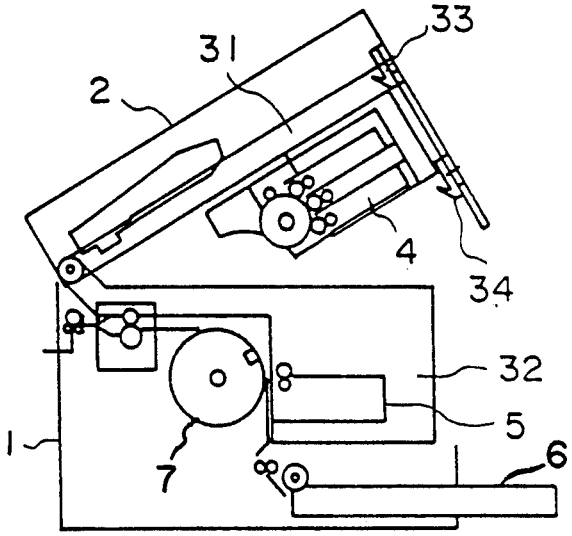
FIG. 11 is a side view of the image forming apparatus which is opened in a second mode.
Figure 12:
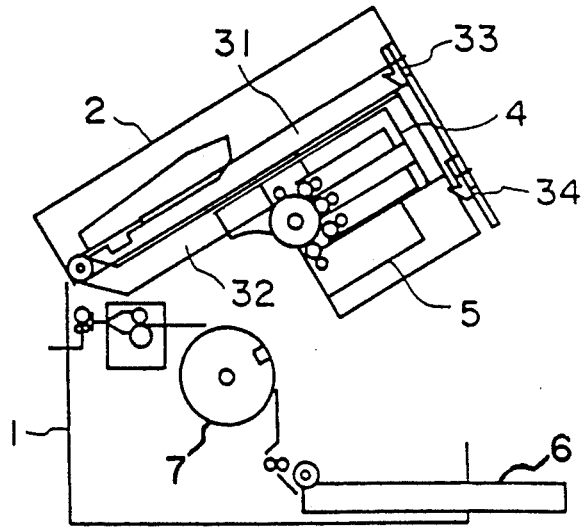
FIG. 12 is a sectional view of the image forming apparatus which is opened in a third mode.

Referring to FIGS. 9, 10, 11 and 12, a fourth embodiment will be described. FIG. 10 is a side sectional view of a multi-color image forming apparatus according to this embodiment. FIGS. 10–12 are side sectional views of the image forming apparatus in various modes.

In this embodiment, the upper frame 2 is provided with a frame 31 for holding the main cartridge 4 and a frame 32 for holding the sub-cartridge 5, and they are rotatable about a shaft 3. The upper frame 2 is provided with fixing members 33 and 34 for fixing the frames 31 and 32 to the upper frame 2, and the fixing members 33 and 34 are rotatable about shafts 35 and 36. The fixing members 33 and 34 are urged in the direction indicated by unshown springs.

Adjacent the fixing members 33 and 34 of the upper frame 2, there are slide levers 37 and 38 slidable in the vertical direction. When the slide levers 37 and 38 are slid upwardly, end portions of the fixing members 33 and 34 are urged by the slide levers 37 and 38 to rotate in the counterclockwise direction about the shafts 35 and .36, by which the engagement between the fixing members 33 and 34 and the frames 31 and 32, are released.

When the slide levers 37 and 28 are slid upwardly, the engagement between the fixing members 33 and 34 and the frames 31 and 32, are released. Then, if the upper frame 2 is opened, the frames 31 and 32, as shown in FIG. 10, the main cartridge 4 and the sub-cartridge 5 remain in the main assembly 1. Therefore, the main cartridge 4 is taken out of the main apparatus 1, and may be exchanged with a fresh one.

When only slide lever 38 is slide upwardly, the engagement between the fixing member 33 and the frame 31 is released, and the engagement between the fixing member 34 and the frame 32 is released. When the upper frame 2 is opened, the frame 31 and the main cartridge 4 mounted thereon are raised together with the upper frame 2, as shown in FIG. 11. The sub-cartridge 5 supported on the frame 32 remains in the main assembly 1. Then, the sub-cartridge 5 may be taken out of the main assembly 1, and can be exchanged with a new one.

When the upper frame 2 is opened without sliding the slide lever 37 or 38, the frames 31 and 32 and the main cartridge 4 and the sub-cartridge 5 supported thereon, are raised together with the upper frame 2, as shown in FIG. 12. With this state, the jammed sheet in the sheet feeding unit 6 or the transfer drum 7 can be removed without difficulty, and in addition, the cleaning and servicing operations to the transfer drum 7 can be carried out with good operativity.

As described in the foregoing, according to the present invention, the apparatus is operable in a first mode in which the cartridge and the developing unit are located in the same frame (first or second), and in a second mode in which the cartridge and the developing unit are located separately in the first or second frames. Therefore, the jam clearance operation, the maintenance operation, exchanging operation of the cartridge or the developing unit, can be carried out without difficulty.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

first and second frames separable from each other, wherein said first and second frames comprise a main assembly of said image forming apparatus;

a process cartridge detachably mountable to said main assembly, wherein said process cartridge includes an image bearing member;

a developing unit detachably mountable to said main assembly separately from said cartridge, said developing unit supplying a developer on said image bearing member;

wherein said main assembly is separable in a first mode in which said process cartridge and said developing unit are both in said first frame and in a second mode in which said cartridge and said developing unit are in different ones of said first and second frames and in a third mode in which said process cartridge and said developing unit are both in said second frame.

2. An apparatus according to claim 1, wherein said process cartridge further includes at least one image forming means actable on said image bearing member, charging means for charging said image bearing member, and at least one of developing means for forming a developed image on said image bearing member and cleaning means for removing residual matter from said image bearing member.

3. An apparatus according to claim 2, wherein said image forming means includes a plurality of developing means.

4. An apparatus according to claim 3, wherein said plurality of developing means contain different color developers.

5. An apparatus according to claim 4, wherein said different color developers have yellow, magenta, and cyan colors.

6. An apparatus according to claim 1, wherein said developing unit contains a black developer.

7. An apparatus according to claim 1, further comprising selecting means for manually selecting said first mode or said second mode.

8. An apparatus according to claim 1, wherein a second developing unit is detachably mountable to said main assembly.

9. An apparatus according to claim 2, wherein said process cartridge contains, as said image forming means, at least one of a charging means, developing means or cleaning means which is unified with said image bearing member in said process cartridge, and wherein said image bearing member is an electrophotographic photosensitive member.

10. An apparatus according to claim 2, wherein said process cartridge contains, as said image forming means, a charging means, developing means and cleaning means which are unified with said image bearing member in said process cartridge, and wherein said image bearing member is an electrophotographic photosensitive member.

11. An apparatus according to claim 2, wherein said process cartridge contains, as said image forming means, a developing means which is unified with said image bearing member in said process cartridge, and wherein said image bearing member is an electrophotographic photosensitive member.

12. An apparatus according to claim 2, further comprising first detecting means for detecting a remaining amount of the developer in said cartridge and second detecting means for detecting a remaining amount of the developer in said developing unit.

13. An apparatus according to claim 12, further comprising third detecting means for detecting an amount of the matter collected by said cleaning means.

14. An apparatus according to claim 12, further comprising display means for displaying necessity for exchange of said cartridge or said developing unit in accordance with an output of said first detecting means of said second detecting means.

15. An apparatus according to claim 13, further comprising display means for displaying necessity for exchange of said cartridge or said developing unit in accordance with outputs of said first detecting means, said second detecting means or said third detecting means.

16. An apparatus according to claim 12, further comprising control means for automatically selecting said first mode or said second mode in accordance with outputs of said first detecting means and said second detecting means.

17. An image forming apparatus comprising:

first and second frames separable from each other, wherein said first and second frames comprise a main assembly of said image forming apparatus;

a process cartridge detachably mountable to said main assembly, wherein said process cartridge contains an image bearing member and a developing unit having a developer actable on said image bearing member;

wherein when said process cartridge is mounted in said main assembly, said main assembly being separable in a mode in which said first frame supports said process cartridge and in a second mode in which said second frame supports said process cartridge;

a passage for feeding a recording material;

jam detecting means for detecting an occurrence of a jam of the recording material in said passage;

developer detecting means for detecting a predetermined amount of developer in said developing unit; and selecting means for selecting a mode of separation of said main assembly on the basis of an output any one of said jam detecting means and said developer detecting means.

18. An apparatus according to claim 17, further comprising operating means for separating said main assembly into said first frame and second frame, wherein when an operator operates said operating means after an output is produced from any one of said jam detecting means and said developer detecting means, said main assembly being automatically separated in the mode selected by said selecting means.

19. An apparatus according to claim 17, further comprising mans for notifying the separation mode selected by said selecting means.

* * * * *

UNITED STATES PATENT AND TRADEMARK OFFICE

CERTIFICATE OF CORRECTION

PATENT NO. : 5,323,210

DATED : June 21, 1994

INVENTOR(S) : MITSUGU INOMATA

It is certified that error appears in the above-indentified patent and that said Letters Patent is hereby corrected as shown below:

ON COVER PAGE:

At [54] In The Title:
Lines 2 and 3, "SERVICE ACCESS" should read --SERVICE-ACCESS--.

At [57] Under the Heading "ABSTRACT":
Line 3, "constitutes" should read --constitute--.

IN THE DRAWINGS:
Sheet 11 of 11, (in the box labeled "STEP 5"), "CARTRIGE 4" should read --CARTRIDGE 4--.

COLUMN 1:
Line 2, "SERVICE ACCESS" should read --SERVICE-ACCESS--;
Line 29, "are different" should be deleted; and
Line 34, "developers," should read --developers--.

COLUMN 2:
Line 47, "drawings" should read --drawings,--.

COLUMN 6:
Line 39, "Go" should read --to--;
Line 58, "cams" should be deleted.

COLUMN 7:
Line 31, ".the" should read --the--;
Line 54, ".36," should read --36,--; and
Line 57, "28" should read --38--.

UNITED STATES PATENT AND TRADEMARK OFFICE

CERTIFICATE OF CORRECTION

PATENT NO. : 5,323,210

DATED : June 21, 1994

INVENTOR(S) : MITSUGU INOMATA

It is certified that error appears in the above-indentified patent and that said Letters Patent is hereby corrected as shown below:

COLUMN 9:

Line 12, Q: "or" should read --and--?.

COLUMN 10:

Line 30, "output" should read --output,--.

Signed and Sealed this

Thirteenth Day of December, 1994

*Attest:*

*Attesting Officer*

Bruce Lehman

BRUCE LEHMAN

*Commissioner of Patents and Trademarks*